United States Patent [19]

Brown

[11] Patent Number: 4,759,088

[45] Date of Patent: Jul. 26, 1988

[54] SELF ALIGNING MATTRESS ASSEMBLY

[76] Inventor: Robert H. Brown, 5381 Seven Island Rd., Madison, Ga. 30650

[21] Appl. No.: 23,961

[22] Filed: Mar. 9, 1987

Related U.S. Application Data

[63] Continuation of Ser. No. 758,333, Jul. 24, 1985, abandoned.

[51] Int. Cl.[4] ..... A47C 27/00; A47C 19/00; A47C 23/00

[52] U.S. Cl. ..... 5/401; 5/193; 5/411; 5/448

[58] Field of Search ..... 5/411, 481, 200 R, 400, 5/401, 402, 448, 475, 193

[56] References Cited

U.S. PATENT DOCUMENTS

| | | | |
|---|---|---|---|
| 1,876,102 | 9/1932 | Thum | 5/200 R |
| 2,417,333 | 3/1947 | Waetzman | 5/411 |
| 2,858,881 | 11/1958 | Newall et al. | 5/481 |
| 3,222,697 | 12/1965 | Scheermesser | 5/481 |
| 3,665,530 | 5/1972 | Basner | 5/481 |
| 3,732,585 | 5/1973 | Krehbiel | 5/400 |
| 4,057,862 | 11/1977 | LaBianco | 5/496 |
| 4,145,781 | 3/1979 | Autrey et al. | 5/402 |
| 4,167,049 | 9/1979 | Fogel | 5/402 |
| 4,197,602 | 4/1980 | Johenning | 5/411 |
| 4,242,766 | 1/1981 | Allegro | 5/284 |

FOREIGN PATENT DOCUMENTS

| | | | |
|---|---|---|---|
| 670328 | 9/1963 | Canada | 5/411 |
| 1422532 | 1/1965 | France | 5/481 |
| 2241955 | 3/1975 | France | 5/481 |
| 2315243 | 1/1977 | France | 5/200 R |
| 255154 | 7/1926 | United Kingdom | 5/200 R |
| 1308852 | 3/1973 | United Kingdom | 5/400 |

*Primary Examiner*—Alexander Grosz

*Attorney, Agent, or Firm*—Hurt, Richardson, Garner, Todd & Cadenhead

[57] ABSTRACT

A bed mattress is constructed so that its opposite sides have marginal inclined surfaces which converge to form a relatively shallow truncated rectangular wedge portion on each side of the mattress for self-centering nested engagement in a similarly tapered cavity of a foundation for the mattress. The mattress may be of the innerspring type or may consist of a foam rubber slab. The mattress foundation can be framed and padded or may be formed from rigid foam plastics material.

4 Claims, 2 Drawing Sheets

SELF ALIGNING MATTRESS ASSEMBLY

This is a continuation of co-pending application Ser. No. 758,333 filed on July 24, 1985, now abandoned.

BACKGROUND OF THE INVENTION

The object of the present invention is to provide a reversible self-centering mattress and a coacting mattress foundation.

In accordance with the present invention, the mattress may be of the innerspring type or may consist of an integral slab of foam rubber, either solid or honeycombed. The mattress foundation may include a fabricated frame with suitable padding, or may simply consist of rigid styrofoam or the like.

In accordance with the invention, the self-centering mattress and mattress foundation can be made in all customary sizes, single, double, queen or king size. In the latter instance, the foundation can be divided for passage around corners on stairways and the like.

Other features and advantages of the invention will become apparent to those skilled in the art during the course of the following detailed description.

DETAILED DESCRIPTION

Figure 1:
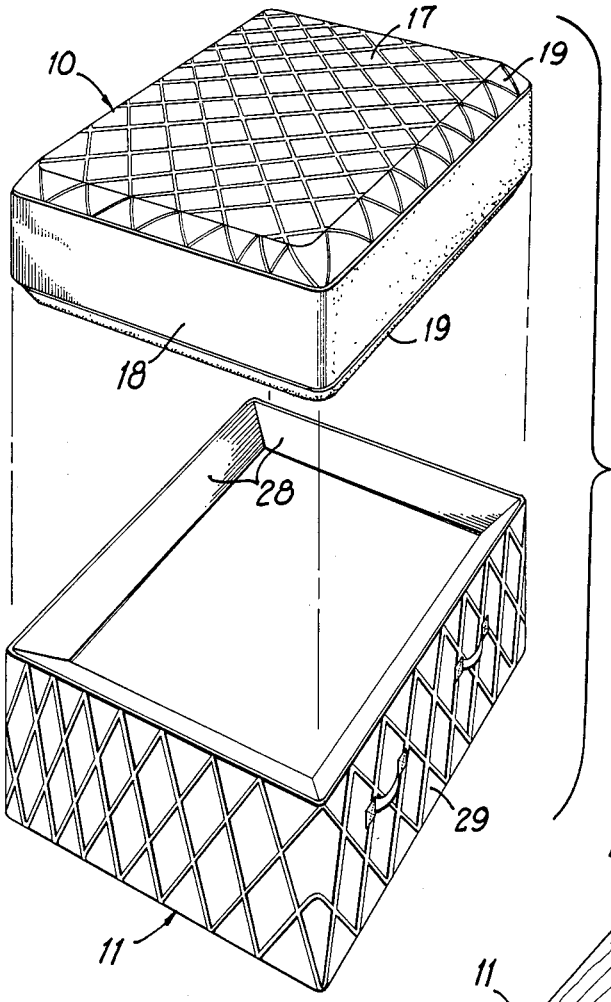
FIG. 1 is an exploded perspective view of a selfcentering mattress and mattress foundation according to the present invention.
Figure 2:
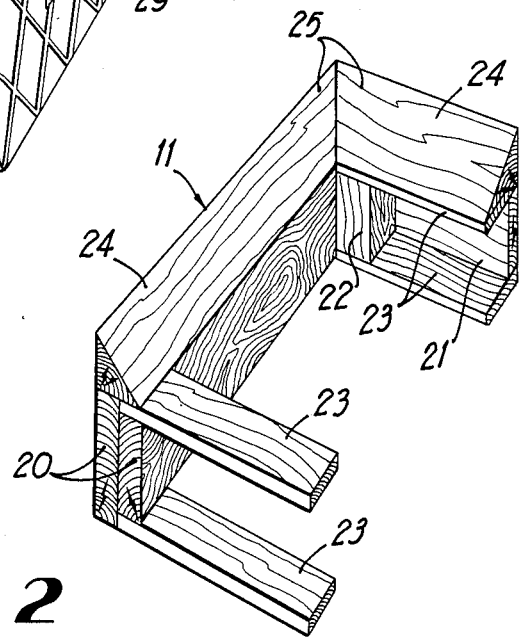
FIG. 2 is a fragmentary perspective view in cross section through the mattress foundation FIG. 1.
Figure 3:
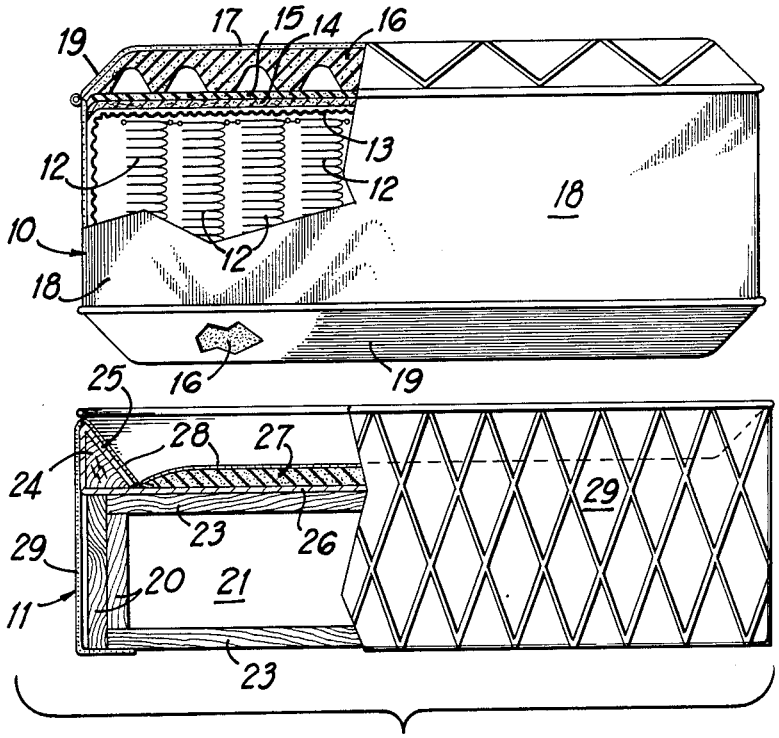
FIG. 3 is an exploded vertical section, partly in elevation, taken through the self-centering mattress and mattress foundation.

Referring to the drawings in detail wherein like numerals designate like parts, a reversible self-centering bed mattress 10 and a coacting mattress foundation 11 are shown in drawing FIGS. 1 and 3. The mattress 10 may include conventional inner springs 12 held within a conventional envelope 13. The top and bottom faces of this envelope are preferably covered by insulator pads 14 and foam sheets 15. Slabs 16 of honeycombed foam rubber or the like are placed on the outer faces of the sheets 15 and cover the latter. The slabs 16 are covered by preferably quilted decorative fabric 17 and mattress ticking 18 defines the margin of the bed mattress.

Each fabric-covered foam slab 16 has an inclined marginal surface 19 extending continuously around its four sides and corners. This inclined marginal surface forms on each major side of the mattress a relatively shallow truncated rectangular tapered projection or wedge whose marginal edges converge away from a median horizontal plane through the mattress. The tapered projections on each side of the mattress are of uniform and equal thicknesses so that the mattress is symmetrical in cross section as shown in FIG. 3. The tapering projections formed by the slabs 16 impart to the mattress 10 its self-centering capability and reversibility in conjunction with the mattress foundation 11.

The foundation 11 may have a fabricated rigid frame comprising longitudinal and transverse lumber sections

20 and 21 joined at the four corners of the foundation by post elements 22. Horizontal cross braces 23 are provided at the head and foot ends of the foundation and preferably at one or more intervening points to render the foundation stable in its support of the mattress 10.

Right triangular marginal lumber sections 24 mounted atop the upper braces 23 and lumber sections 20 and 21 include interior sloping downwardly converging surfaces 25 which collectively define a tapered rectangular cavity having roughly the same height and marginal configuration as the two described tapered projections on the opposite sides of the mattress 10.

The wooden frame of the mattress foundation 11 is covered as shown in FIG. 3 by a flexible pad 26, a foam sheet 27, and decking 28. The pad 26 and decking extend around the right trianmgular members 24. FIG. 3, and the foundations 11 are preferably covered with mattress ticking 29, as shown.

Figure 4:
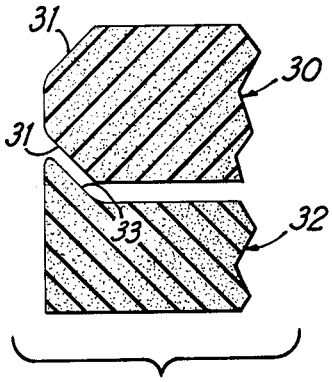
FIG. 4 is a fragmentary vertical section taken through a mattress and mattress foundation according to a modification of the invention.

In lieu of the innerspring mattress 10, the self-centering mattress may be formed from a unitary slab 30 of foam rubber, as shown in FIG. 4, having upper and lower marginal inclined surfaces 31 forming on the opposite sides of the mattress 30 two oppositely tapering self-centering projections. In lieu of the fabricated mattress foundation 11, a mattress foundation 32, FIG. 4, may be formed from rigid foam material, such as rigid styrofoam. In such case, the foundation 32 is recessed in its top to form a downwardly tapering shallow rectangular cavity 33 of the proper uniform depth and area to accept either tapering projection of the mattress 30 in self-centering relationship.

Figure 5:
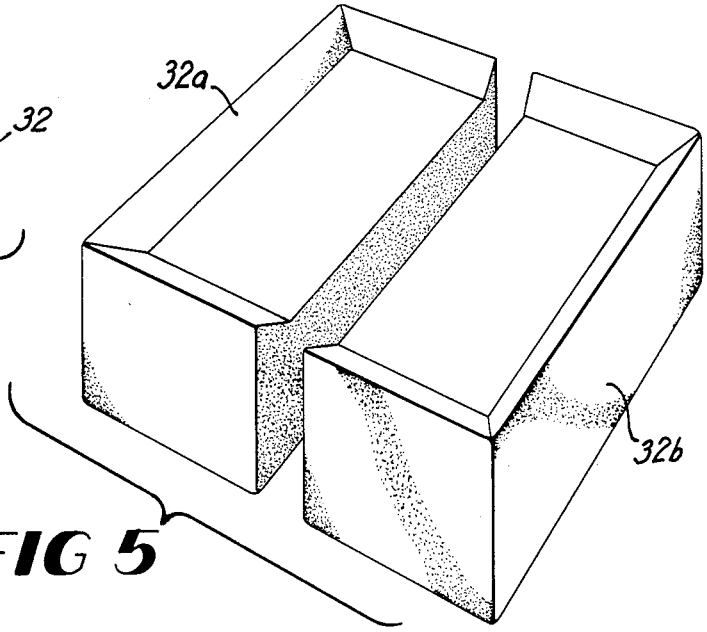
FIG. 5 is a perspective view of a two-part foundation for a king size mattress.

In the case of a king size mattress, the styrofoam mattress foundation as shown in FIG. 5 may be constructed in two separable sections **32*a* and 32*b* formed in their tops to provide the downwardly tapering rectangular cavity or well to receive a self-centering mattress. The two foundation sections 32*a* and 32*b*** can be transported separately through narrow passages where a single king size foundation might not pass. The two foundation sections are held in assembled relationship with the mattress by a surrounding bed frame, not shown.

In either form of the invention, a reversible symmetrical self-centering mattress is provided for placement on a mattress foundation having a tapered cavity or well of the proper size and tapering depth to receive a mating truncated tapered projection on either side of the mattress. The interfitting relationship of these mattress projections with the tapered well of the mattress foundation renders the bed mattress self-centering when either side of the mattress is placed on the foundation.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A self-centering mattress structure comprising a substantially rigid mattress foundation having a shallow top cavity with top edges, a flat bottom wall, and sloping downwardly convergent side walls extending between said top edges and said bottom wall, and a reversible mattress having on each side thereof a tapering projection and vertical exterior side walls extending between and connecting the trapering projections and including marginal sloping side walls which converge away from a median plane through the mattress, each tapering projection being adapted to interfit in nested centering relationship within said cavity of the mattress foundation with the sloping side walls of the cavity in engagement with the marginal sloping side walls of each mattress tapering projection and the top edges of the cavity side walls being adjacent to the vertical exterior side walls of the mattress.

2. A self-centering mattress structure as defined in claim 1, and the mattress foundation comprising a fabricated framed padded and fabric covered foundation, and the mattress comprising an innerspring mattress having opposite side foam slab elements forming said tapering projections.

3. A self-centering mattress structure as defined in claim 1, and the mattress foundation comprising a body of substantially rigid plastic foam, and the mattress comprising a body of elastic foam material.

4. A self-centering mattress structure as defined in claim 3, and the mattress foundation and mattress being king size, and the mattress foundation being divided into a pair of substantially equal size foundation sections.

* * * * *